US006012932A

United States Patent [19]

Vanbesien

[11] Patent Number: 6,012,932

[45] Date of Patent: Jan. 11, 2000

[54] CABLE CONNECTOR WITH A GROUNDING CONTACT

[75] Inventor: Johan Vanbesien, Ypres, Belgium

[73] Assignee: Siemens Aktiengesellschaft, Munich, Germany

[21] Appl. No.: 09/160,879

[22] Filed: Sep. 25, 1998

[30] Foreign Application Priority Data

Sep. 29, 1997 [DE] Germany ..... 197 42 992

[51] Int. Cl.[7] ..... H01R 4/66

[52] U.S. Cl. ..... 439/101; 439/101; 439/108; 439/95; 439/696; 439/687; 439/497

[58] Field of Search ..... 439/101, 108, 439/95, 696, 687, 497

[56] References Cited

U.S. PATENT DOCUMENTS

| | | | |
|---|---|---|---|
| 4,163,598 | 8/1979 | Bianchi et al. | 339/107 |
| 4,571,012 | 2/1986 | Bassler et al. | 339/14 |
| 4,619,487 | 10/1986 | Brush, Jr. | 339/14 |
| 4,961,711 | 10/1990 | Fujiura et al. | 439/357 |
| 5,000,703 | 3/1991 | Biederstedt et al. | 439/709 |
| 5,052,949 | 10/1991 | Lopata et al. | 439/610 |
| 5,085,596 | 2/1992 | Bowen et al. | 439/497 |
| 5,288,247 | 2/1994 | Kaufman | 439/607 |
| 5,380,223 | 1/1995 | Marsh et al. | 439/610 |
| 5,518,421 | 5/1996 | Davis | 439/607 |

FOREIGN PATENT DOCUMENTS

| | | |
|---|---|---|
| 8713046 | 3/1989 | Germany . |
| 3902575C1 | 3/1990 | Germany . |
| 9303361 | 5/1994 | Germany . |

*Primary Examiner*—Paula Bradley
*Assistant Examiner*—Truc Nguyen
*Attorney, Agent, or Firm*—Herbert L. Lerner; Laurence A. Greenberg

[57] ABSTRACT

A cable connector with a grounding contact having a bipartite connector housing formed of two mutually closable parts having therein a strip member formed of plastic material and provided with plug-in contacts, and a grounding plate having at one side thereof a terminal element for cable shielding, and on another side thereof a plurality of contact lugs extending at an angle away from the grounding plate, includes insulation-piercing connecting devices formed on the plug-in contacts of the strip member in a line terminal region thereof, the insulation-piercing connecting devices being accessible from an outer side of the strip member, the contact lugs being formed and arranged in the vicinity of the insulation-piercing connecting devices so that they can make contact with the respective insulation-piercing connecting devices assigned thereto, when the two parts of the connector housing are closed.

5 Claims, 1 Drawing Sheet

CABLE CONNECTOR WITH A GROUNDING CONTACT

BACKGROUND OF THE INVENTION

1. Field of the Invention

The invention relates to a cable connector with a grounding contact, the cable connector including, more particularly, a bipartite connector housing having therein a strip member formed of plastic material and provided with plug-in contacts, and a grounding plate having at one side thereof a terminal element for a cable shield, and on another side thereof a plurality of contact lugs extending at an angle away from the grounding plate.

When cables with grounding are connected, for example, via the shielding braid of the cable to a plug-in transfer system, for example, it is also necessary, for the most part, to guide the grounding connection farther into the backplane or back wall conductor plate.

The published German Patent Document DE 87 13 046 U1 has disclosed an electric plug-in connector having a bipartite housing formed of insulating material, wherein electric shielding is achieved by a metallic shielding surface which is in the form of a plate, respectively, covering the individual housing parts on the inside. When the housing is assembled, the shielding plates are connected electrically not directly but, in each case, by contact being made with a metallic plug-in member inserted into the housing, and with shielding of a cable guided into the housing. In this regard, an exposed part of the shielding braid is connected by a clamp mechanically to the lower housing part, and electrically to the metallic plug-in members, and the shielding plates are provided with a comb-like edge region which is bent upwardly and bears against a cover on the plug-in member after the housing has been closed.

Furthermore known heretofore from the published German Patent Document DE 93 03 361 U1 is a rapid-assembly connector having two housing half-shells which include plug-in contacts, for example, in the form of a multipole, such as a fourpole, male connector or terminal strip, or a female connector or spring contact strip. Moreover, the lower housing half-shell is constructed with a grounding plate which is connected at one side thereof to a grounding contact spring for the purpose of further connecting it to the cable shielding braid, and is provided at an opposite side of the grounding plate with a grounding contact comb formed from bent-away prongs. It is possible, in this manner, to achieve a reliable grounding contact after the connector has been plugged in, for example via a front plate, at ground potential, for example, of a subassembly rack or carrier.

Furthermore, in the case of partially shielded transfer systems it is customary to have cable connectors with housings formed of two metal half-shells and a bipartite female connector member or spring contact strip formed of plastic material. In these cable connectors, contact between the cable shielding and the metal housing parts is made, for example, in the aforementioned manner, for example, by screwing on a metal band or by using a crimping sleeve, further contacting with a backplane or rearwall backplate being realized by additional grounding contacts, which are inserted into the female connector member or spring contact strip, and are constructed especially for this purpose, the grounding contacts producing a connection between the cable connector housing and grounding contact elements of the backplane or rearwall backplate.

SUMMARY OF THE INVENTION

It is accordingly an object of the invention to provide a cable connector having a grounding contact which makes a cost-effective grounding connection possible in a relatively simple manner.

With the foregoing and other objects in view, there is provided, in accordance with the invention, a cable connector with a grounding contact, including a bipartite connector housing formed of two mutually closable parts having therein a strip member formed of plastic material and provided with plug-in contacts, and a grounding plate having at one side thereof a terminal element for cable shielding, and on another side thereof a plurality of contact lugs extending at an angle away from the grounding plate, comprising insulation-piercing connecting devices formed on the plug-in contacts of the strip member in a line terminal region thereof, the insulation-piercing connecting devices being accessible from an outer side of the strip member, the contact lugs being formed and arranged in the vicinity of the insulation-piercing connecting devices so that they can make contact with the respective insulation-piercing connecting devices assigned thereto, when the two parts of the connector housing are closed.

In accordance with another feature of the invention, the contact lugs are located on a side of the grounding plate facing towards a side of the cable connector at which it is plugged in.

In accordance with a further feature of the invention, the contact lugs are formed by separating cuts on an edge of the ground plate and are bent away in a direction towards the assigned insulation-piercing connecting devices.

In accordance with an added feature of the invention, the contact lugs, respectively, have a thickness corresponding approximately to the width of respective slots between the insulation-piercing connecting devices.

In accordance with a concomitant feature of the invention, the ground plate is fixed in a correct position with respect to the strip member and the assigned insulation-piercing connecting devices by shaped elements selected from groups thereof consisting of shaped elements belonging to the ground plate itself, and shaped elements of a connector housing part.

With such a cable connector according to the invention, the strip member with the plug-in contacts is constructed with insulation-piercing connecting devices, and the ground plate is provided at specific locations thereof with contact lugs which, upon the closure of the two housing parts, are pressed into respective ones of the insulation-piercing connecting devices and make contact therein. Accordingly, some of the plug-in contacts can be used as ground contacts due to a connection between the insulation-piercing connecting devices thereof and the contact lugs, while the remaining plug-in contacts, which are constructed in the line terminal region likewise with such insulation-piercing connecting devices, serve the purpose of connecting cable signalling wires. Thus, when the cable connector is plugged into a backplane or rear wall mating connector, for example, the grounding is realized simultaneously with the signal transmission, in each case via similar contacts of the cable connector and of the backplane or rear wall mating connector. A material advantage of the cable connector according to the invention thus is that a grounding connection is able to be provided in a relatively simple and cost effective manner, because special grounding contacts in the cable connector are dispensed with or eliminated, similar plug-in contacts can be used in each case for signal guidance and grounding both on the side of the cable connector and on the opposite side, the plug-in contacts can be provided on the side of the cable connector in a uniform manner with standard insulation-piercing connecting devices, and the connection of the contact lugs of the grounding plate to the insulation-piercing connecting devices is performed simply during the closure of the cable connector housing parts, i.e., without any additional operations.

Other features which are considered as characteristic for the invention are set forth in the appended claims.

Although the invention is illustrated and described herein as embodied in a cable connector with a grounding contact, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
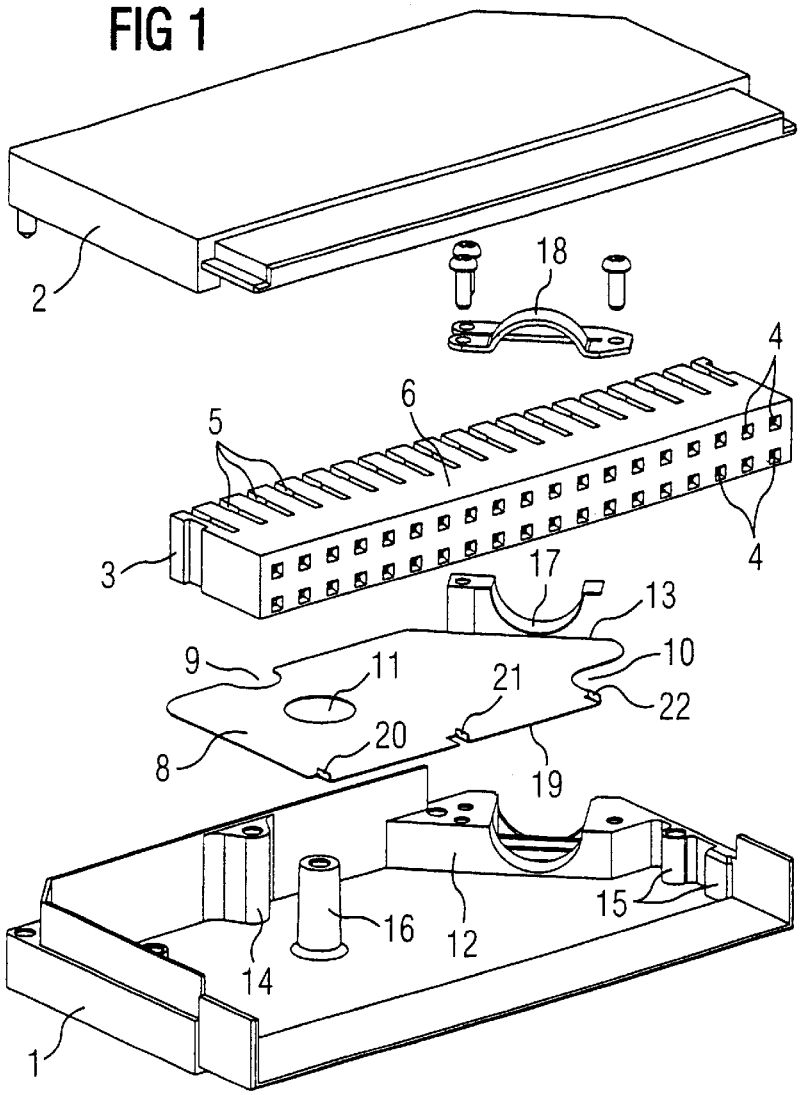
FIG. 1 is an exploded rear, side and top view of a cable connector according to the invention, showing the individual parts thereof.
Figure 2:
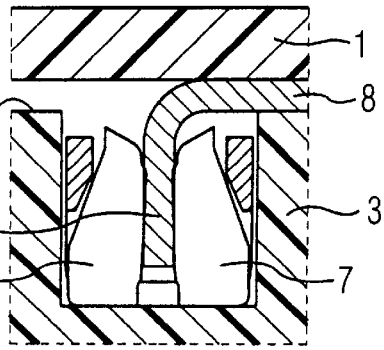
FIG. 2 is a fragmentary, diagrammatic sectional view of the realization of a grounding contact for the cable connector according to FIG. 1.

Referring now to the drawing and, first, particularly to FIG. 1 thereof, there is shown therein a cable connector according to the invention having a bipartite connector housing 1, 2 of plastic material formed in the illustrated embodiment of two housing halves, namely, a lower housing part 1 and an upper housing part 2. The connector housing 1, 2 includes a strip member 3 formed of plastic material and having two rows of contact chambers 4 which open towards the insertion or plug-in side of the cable connector. Insertable into these contact chambers 4 are plug-in contacts formed by contact springs of conventional construction, and therefore not shown in greater detail in the drawing, such conventional plug-in contacts being provided, in a similarly conventional and long known manner, with standard, insulation-piercing connecting devices 7 in a line terminal region thereof. The strip member 3 in the line terminal region of the plug-in contacts, i.e., in the region of the insulation-piercing connecting devices, is provided on two mutually opposite outer surfaces thereof with outwardly open and mutually parallel slots 5 which, because of the particular view of FIG. 1, is seen only on the upper outer surface 6 of the strip member 3 facing the viewer. Consequently, individual insulated wires of a multi-core, conventional, and therefore likewise of a non-illustrated, cable with yet unstripped or unbared cable shielding can be thrust from outside against the insulation-piercing connecting devices of the plug-in contacts. More details regarding the arrangement of the insulation-piercing connecting device 7 in a slot 5 of a strip member 3 constructed as a U-shaped channel are shown in FIG. 2.

Besides the strip member 3, there is provided in the lower housing part 1 of the connector housing, a ground plate 8 formed of sheetmetal which can be fixed, with respect to the strip member 3 and the insulation-piercing connecting devices 7, in a correct position in the lower housing part 1 by its own shaped elements such as, for example, marginal cutouts 9, 10, a hole 11 and an oblique side 13 matching or adjusted to the inner oblique surface 12 of the housing part 1, as well as by wall projections 14 and 15, a tower 16 on the base of the housing part 1, and the aforementioned oblique surface 12 of the housing part 1.

In order to form the ground reference potential, the grounding plate 8 is constructed, on the oblique side 13 thereof, with a semicircular clamping ring 17 which extends at an angle away therefrom and which, together with a clip 18, can be secured by screws thereon, forms a clamping connection for the shielding braid of the cable. Furthermore, the grounding plate 8 is provided, on a further side thereof, in this case on the longitudinal side 19 facing the plug-in side of the cable connector, with contact lugs 20, 21 and 22 which are formed by separating cuts on the longitudinal side and are bent upwardly in the direction of the strip member 3 and the insulation-piercing connecting devices 7. Three contact lugs 20, 21 and 22 are provided thereat, and arranged at the ends of the longitudinal side 19 as well as approximately in the middle thereof. In each case, and independently of the number of contact lugs, the latter are arranged in each case in a region of the grounding plate 8 which is situated opposite the insulation-piercing connecting devices 7 of the strip member 3 which are accessible from outside and thus open, and this is ensured by having the grounding plate 8 fixed in the correct position thereof. The contact lugs 20, 21 and 22 are thus constructed and arranged so that, upon closure of the housing parts 1 and 2, the lugs 20, 21 and 23 are pressed into three opposite insulation-piercing connecting devices 7 of the strip member 3 and make contact therein. As is apparent in FIG. 2, it is expedient for the thickness of the contact lugs 20, 21 and 22 to correspond approximately to the width of the slot of the insulation-piercing connecting devices 7. The rest of the insulation-piercing connecting devices 7, which are likewise formed as standard insulation-piercing connecting devices, serve the purpose of connecting cable signalling wires. When a cable connector is plugged into a backplane or rear wall mating connector, for example, signalling contact and grounding contact are thus realized simultaneously via similar mating contact plugs of the backplane or rear wall mating connector.

With such a cable connector according to the invention, it is thus possible to dispense with special grounding contacts in an advantageous manner, signals being conducted and a grounding connection being produced in a relatively simple manner without any additional operations while the housing parts of the cable connector are being closed.

I claim:

1. A cable connector with a grounding contact, including a bipartite connector housing formed of two mutually closable parts having therein a strip member formed of plastic material and provided with plug-in contacts, and a grounding plate having at one side thereof a terminal element for cable shielding, and on another side thereof a plurality of contact lugs extending at an angle away from the grounding plate, comprising insulation-piercing connecting devices formed on the plug-in contacts of the strip member in a line terminal region thereof, said insulation-piercing connecting devices being accessible from an outer side of the strip member, the contact lugs being formed and arranged in the vicinity of said insulation-piercing connecting devices so that they can make contact with the respective insulation-piercing connecting devices assigned thereto, when the two parts of the connector housing are closed.

2. The cable connector according to claim 1, wherein the contact lugs are located on a side of the grounding plate facing towards a side of the cable connector at which it is plugged in.

3. The cable connector according to claim 1, wherein the contact lugs are formed by separating cuts on an edge of the ground plate and are bent away in a direction towards said assigned insulation-piercing connecting devices.

4. The cable connector according to claim 1, wherein the contact lugs, respectively, have a thickness corresponding approximately to the width of respective slots between said insulation-piercing connecting devices.

5. The cable connector according to claim 1, wherein the ground plate is fixed in a correct position with respect to the strip member and said assigned insulation-piercing connecting devices by shaped elements selected from groups thereof consisting of shaped elements belonging to the ground plate itself, and shaped elements of a connector housing part.

* * * * *